US005551898A

United States Patent [19]

Matsumoto

[11] Patent Number: 5,551,898

[45] Date of Patent: Sep. 3, 1996

[54] DISCHARGE NOZZLE ARRANGEMENT FOR WATER JET PROPULSION UNIT

[75] Inventor: Chihiro Matsumoto, Hamamatsu, Japan

[73] Assignee: Sanshin Kogyo Kabushiki Kaisha, Hamamatsu, Japan

[21] Appl. No.: 401,930

[22] Filed: Mar. 9, 1995

[51] Int. Cl.[6] ..... B63H 11/11

[52] U.S. Cl. ..... 440/41; 440/42

[58] Field of Search ..... 60/221, 222; 440/38, 440/39, 40, 41, 42, 43, 47

[56] References Cited

U.S. PATENT DOCUMENTS 3,105,353 10/1963 Schulz ..... 440/42
3,266,733 8/1966 Goehler ..... 440/41
3,756,185 9/1973 Breslin ..... 440/42
3,776,173 12/1973 Horwitz ..... 440/42

*Primary Examiner*—Stephen Avila
*Attorney, Agent, or Firm*—Knobbe, Martens, Olson & Bear

[57] ABSTRACT

A number of embodiments of steering nozzle and reverse thrust bucket arrangements for jet propelled watercraft. The steering nozzle, in addition to being mounted for steering movement about a vertically extending steering axis is also mounted for trim adjustment about a horizontally extending axis. A cooperating reverse thrust bucket provides reverse thrust operation. The reverse thrust bucket is either mounted on the hull of the watercraft independently of the jet propulsion unit, on the outer housing of the jet propulsion unit independently of the steering nozzle or on the steering nozzle.

14 Claims, 6 Drawing Sheets

DISCHARGE NOZZLE ARRANGEMENT FOR WATER JET PROPULSION UNIT

BACKGROUND OF THE INVENTION

This invention relates to a water jet propulsion unit for watercraft and more particularly to an improved discharge nozzle arrangement for such a jet propulsion unit.

In one form of jet propulsion unit commonly used with watercraft, the jet propulsion unit is comprised of an outer housing that defines a water inlet portion, an impeller portion in which an impeller is contained for pumping water through the water inlet portion and a discharge nozzle portion through which the water pumped by the impeller is discharged for providing a propulsion force for the associated watercraft. Frequently, the watercraft is also steered by a steering nozzle that is pivotally supported on the discharge nozzle of the outer housing about a vertically extending steering axis. By pivoting the steering nozzle about this axis, a turning force can be associated on the associated watercraft.

With jet propelled watercraft, like other watercraft, the trim of the watercraft is important in providing good handling. If the trim is too high, then the watercraft will ride roughly and may tend to porpoise. On the other hand, if the trim is too low, then the watercraft performance will be deteriorated as it will tend to operate nose down and plow into the water.

It is, therefore, a principal object of this invention to provide an improved arrangement for adjusting the trim of a jet propelled watercraft.

It is a still further object of this invention to provide an improved trim adjustment that can be made through the steering nozzle of a jet propelled watercraft.

It is a still further object of this invention to provide an improved trim control arrangement for the steering nozzle of a jet propelled watercraft.

In addition to the forward motion, frequently it is desirable to provide an arrangement whereby the watercraft can be operated in a reverse mode. This is generally done by providing a reverse thrust bucket which cooperates with the discharge nozzle of the watercraft for providing a reverse thrust to the watercraft when the reverse thrust bucket is shifted to the reverse mode. This is done by redirecting the flow of water from the discharge nozzle in a forward direction.

However, where the jet propulsion unit employs a pivotally supported steering nozzle, it has been previously the practice to mount the reverse thrust bucket on the steering nozzle. This somewhat complicates the mounting arrangement and furthermore makes it necessary that the actuating mechanism for the reverse thrust bucket can accommodate steering movement without having this change the position of the reverse thrust bucket.

It is, therefore, a still further object of this invention to provide an improved reverse thrust bucket and mounting arrangement for a water jet propulsion unit.

In addition to the aforenoted difficulties, if the reverse thrust bucket is mounted on the steering nozzle, then the possibility of mounting the steering nozzle so that it can be moved for trim adjustment becomes much more complicated and difficult.

It is, therefore, a still further object of this invention to provide an improved reverse thrust bucket arrangement for a jet propelled watercraft wherein the steering nozzle of the jet propulsion unit is also mounted for pivotal movement about a horizontal axis in a trim controlling manner.

SUMMARY OF THE INVENTION

A first feature of the invention is adapted to be embodied in a jet propulsion unit for a watercraft that is comprised of an outer housing having a water inlet portion and an impeller portion in which an impeller is rotatably journaled for drawing water through the water inlet portion. A discharge nozzle receives the water pumped by the impeller and discharges it in a rearward direction for providing a propulsion force for the watercraft. A steering nozzle is supported upon the jet propulsion unit discharge nozzle for pivotal movement about a vertically extending axis for effecting steering control of the associated watercraft. In addition, the steering nozzle is supported for pivotal movement about a horizontally extending axis for effecting trim control of the watercraft.

Another feature of the invention is also adapted to be embodied in a jet propulsion unit of the type described in the preceding paragraph. In accordance with this feature of the invention, a reverse thrust bucket arrangement is supported for movement between a forward drive position and a reverse drive position independently of the discharge nozzle but in proximity to the discharge nozzle in any of its angular positions about either axis so that water can be redirected in a forward direction when the reverse thrust bucket is in its reverse position.

DETAILED DESCRIPTION OF THE PREFERRED EMBODIMENTS OF THE INVENTION

Figure 1:
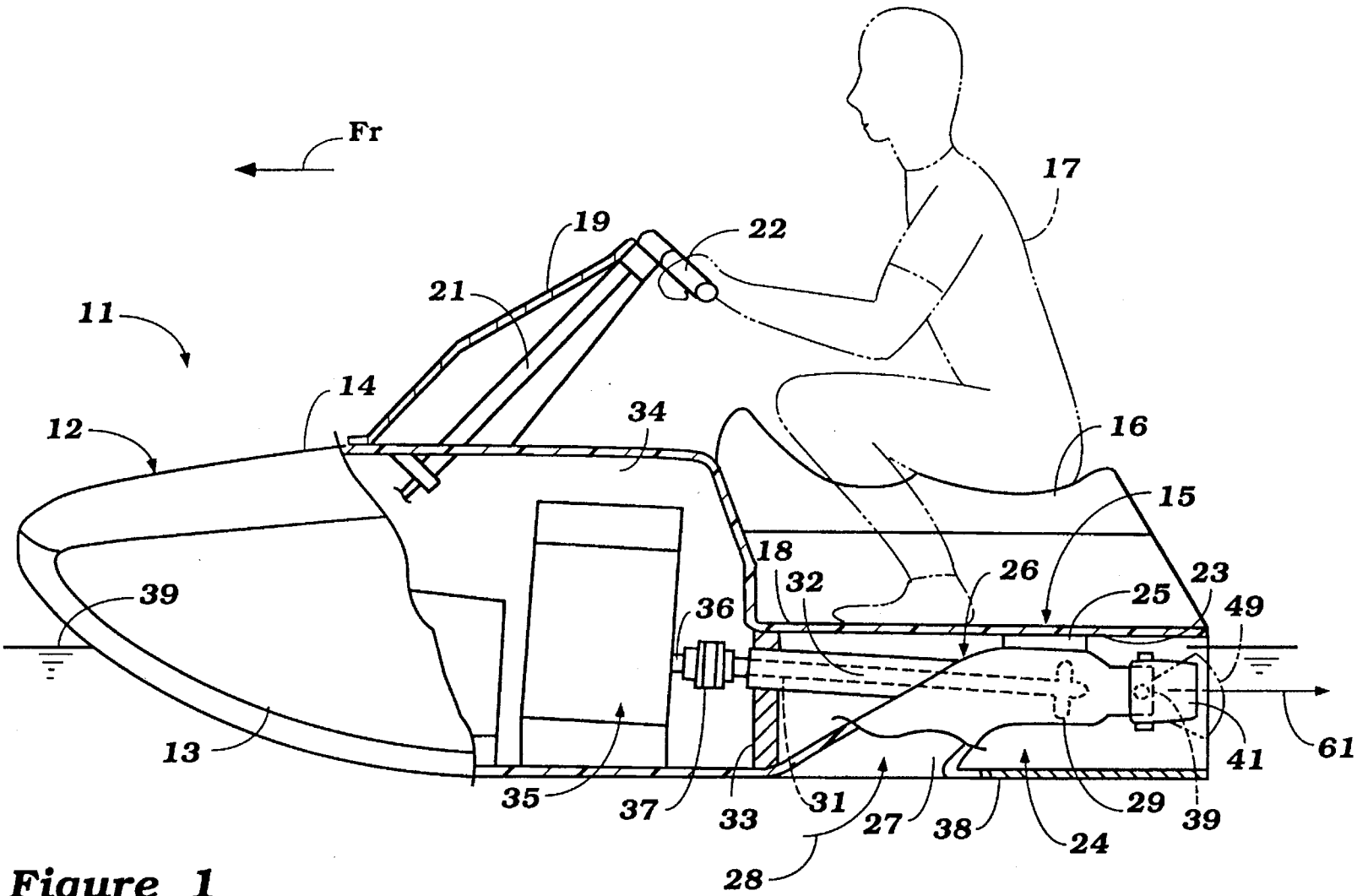
FIG. 1 is a side elevational view of a watercraft constructed in accordance with an embodiment of the invention, with portion broken away and other portions shown in sections.

Referring in detail to the drawings and initially to FIG. 1, a small personal watercraft constructed in accordance with an embodiment of this invention is identified generally by the reference numeral 11. Although the invention is described in conjunction with a personal watercraft, it should be readily apparent to those skilled in the art that the invention can be employed in a wide variety of types of watercraft. The invention has particular utility in conjunction with jet propulsion units for watercraft and personal watercraft are frequently powered by jet propulsion units. Thus, the watercraft 11 is a typical environment in which the invention can be practiced. It is to be understood, however, that the invention may be applied to a wide variety of types of watercraft in addition to that illustrated.

The watercraft 11 is comprised of a hull, indicated generally by the reference numeral 12 and which is comprised of a lower hull portion 13 and an upper deck portion 14. The portions 13 and 14 are formed from a suitable material such as a molded fiberglass resin or the like. The hull and deck portions 13 and 14 are connected to each other in a suitable manner.

A rider's area 15 is formed to the rear of the watercraft and accommodates a seat 16 that is adapted to receive a rider, shown in phantom and identified by the reference numeral 17. The rider 17 sits on the seat 16 in a straddle fashion with his feet on foot areas 18 formed on opposite sides of the seat 16 and in the rider's area 15.

A mast assembly 19 is provided forwardly of the seat 16 and journals a steering shaft 21 in a known manner. A handlebar assembly 22 is carried at the upper end of the steering shaft 21 for steering by the operator 17. The handlebar 22 is connected to a portion of the propulsion unit, to be described, for steering of the watercraft 11 in a known manner. In addition, other watercraft controls may be carried by the handlebar assembly 22 or by the mast 19.

The lower rear central portion of the hull 12 and specifically the area of the hull portion 13 beneath the seat 16 is formed with a tunnel-like recess, indicated generally by the reference numeral 23. A jet propulsion unit, indicated generally by the reference numeral 24, is supported in the tunnel 23 by means including a mounting bracket 25. The jet propulsion unit 24 includes an outer housing assembly 26 that defines a downwardly facing water inlet portion 27 through which water is drawn in the direction shown by the arrow 28. This water is drawn by an impeller 29 that is affixed on an impeller shaft 31 which is journaled in the outer housing 26 and which passes through a forwardly extending tubular portion 32 thereof.

The tubular portion 32 terminates at a bulkhead 33 which is formed at the forward end of the tunnel 23 and which separates it from an engine compartment 34 formed forwardly of the seat 16. An internal combustion engine of any known type, shown schematically and indicated by the reference numeral 35, is mounted in a known manner in the engine compartment 34. The engine 35 has an output shaft 36 which is coupled by a flexible coupling 37 to the impeller shaft 31 for driving it and causing it to pump water to the path as thus far described.

The underside of the tunnel 27 is closed by a bottom plate 38 which is fixed to the hull portion 13 in any known manner. The bottom plate 38 either has an opening which surrounds the water inlet opening 27 of the jet propulsion unit outer housing 26 or terminates short of it so that water can be freely drawn through the path 28.

The water level at normal low speed running conditions is shown in FIG. 1 by the line 39. This also shows the position when a certain type of rider is on the seat. It should be readily apparent that if the rider is lighter or heavier and as the speed of the watercraft changes, the hull 12 will assume different attitudes relative to the water level 39. This is important in that it determines the optimum trim condition for the hull 12, as will be described.

Figure 2:
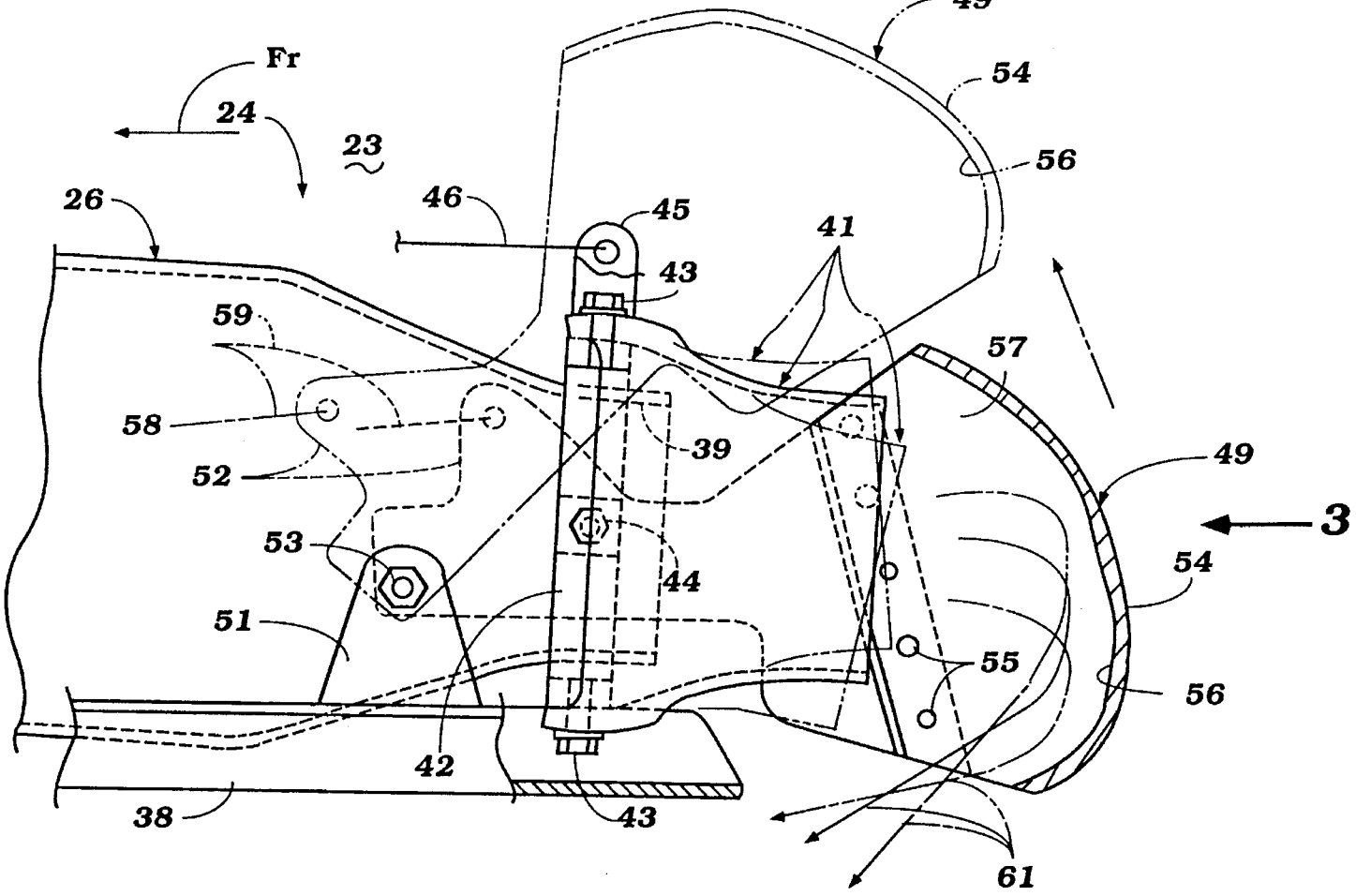
FIG. 2 is an enlarged cross-sectional view taken through the discharge end of the jet propulsion unit and shows the steering nozzle and reverse thrust bucket in solid lines in one trim adjusted position and in the reverse drive mode. Other trim adjusted positions of the steering nozzle and the forward drive position of the reverse thrust bucket are shown in phantom lines.
Figure 3:
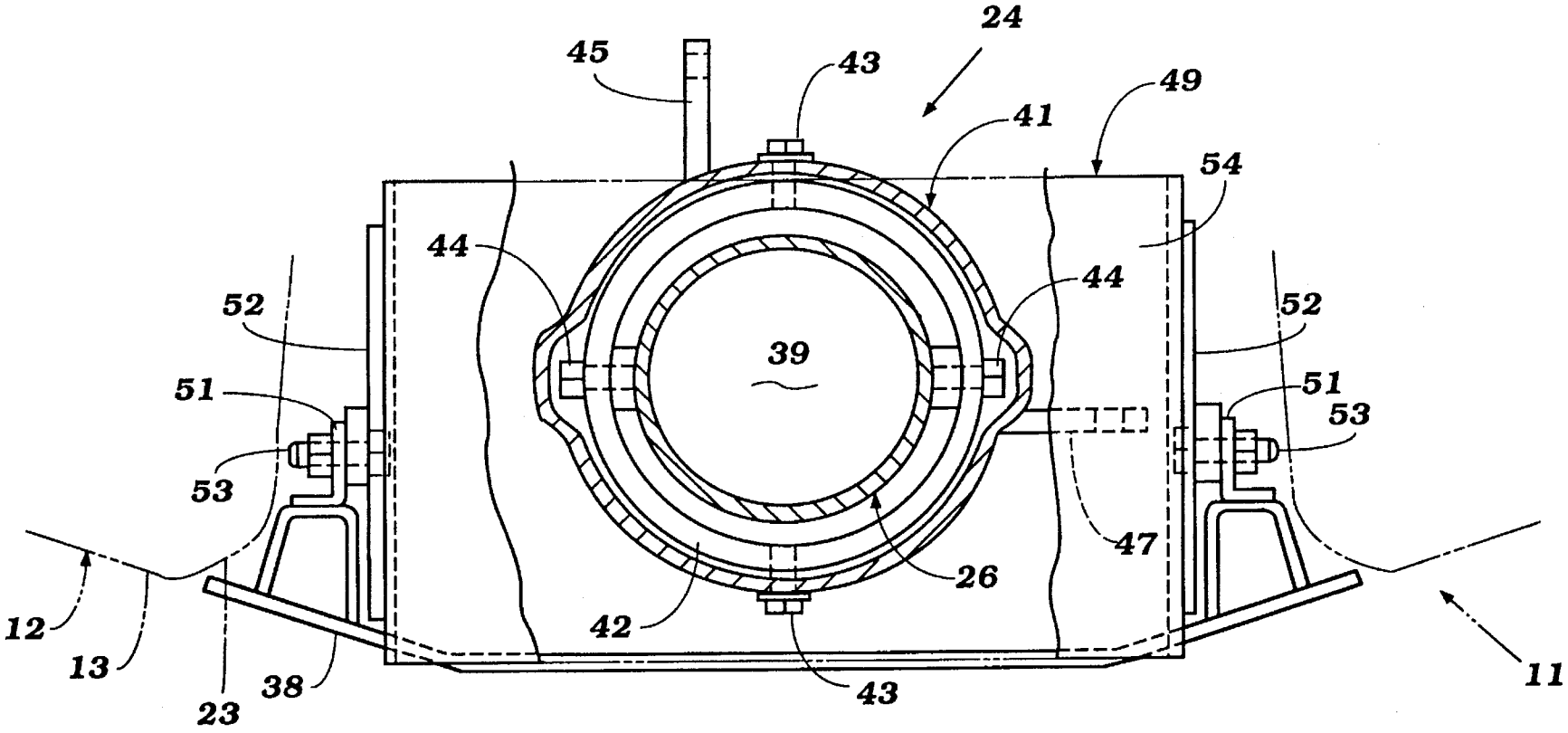
FIG. 3 is a rear elevational view taken in the direction of the arrow 3 in FIG. 2 but with portions of the reverse thrust bucket broken away and portions of the steering nozzle shown in cross-section.

Continuing to describe the jet propulsion unit 24 and specifically now by reference to the remaining figures of this embodiment (FIGS. 2–4), it will be seen that the outer housing 26 of the jet propulsion unit to the rear of the impeller 29 is provided with a reduced diameter discharge nozzle 39 which faces generally rearwardly. Forwardly of this discharge nozzle 39, there may be provided a plurality of straightening vanes (not shown) that straighten the water that is delivered to the discharge nozzle 39. A steering nozzle, indicated generally by the reference numeral 41 is supported on this discharge nozzle 39 in a manner which will be described so as to control the direction of flow of the water so as to effect steering of the watercraft 11 in a manner that is generally known but also so as to provide a trim adjustment therefor.

The steering nozzle 41 has a forward portion that extends forwardly beyond the discharge nozzle 39 of the outer housing 26 of the jet propulsion unit 24. This surrounds a gimble ring 42. A pair of vertically extending steering pivot pins 43 connect the discharge nozzle 41 and specifically this forward portion to the gimble ring 42 for steering movement about a vertically extending steering axis defined by the pivot pins 43. In the specific embodiment illustrated, the pivot pins 43 are pivot bolts that are threaded into tapped openings in the gimble ring 42.

The gimble ring 42 is, in turn, pivotally connected to the outer housing 26 of the jet propulsion unit 24 around its discharge nozzle 39. A pair of horizontally extending pivot bolts 45 are threaded into the outer housing 26 adjacent the discharge nozzle 39 and provide this pivotal connection. Pivotal movement of the gimble ring 42 about the horizontal axis defined by the pivot bolts 44 will be accompanied by pivotal movement of the discharge nozzle 41 in this same direction as shown in the phantom line views of FIG. 2. By effecting this pivotal movement, the direction of water exiting the steering nozzle 41 may be changed in a vertical orientation so as to change the effective trim of the watercraft 11.

A lever portion 45 is affixed to the discharge nozzle 41 and is connected by means of a wire actuator 46 to a trim control positioned in convenient location to the operator 17 on the seat 16. Steering control is effected by a steering lever 47 that is affixed or integrally connected with the steering nozzle 41. A wire actuator 48 connects the steering lever 47 to the handlebar assembly 22 for steering of the steering nozzle 41 as shown in phantom lines in FIG. 4. Hence, both the trim and steering of the watercraft are controlled by the steering nozzle 41 because of its gimble ring connection to the jet propulsion unit discharge nozzle 39.

It should be readily apparent from the foregoing description that the steering nozzle 41 is effective to transmit not only the forward driving thrust to the watercraft 11, but also its steering and trim control. In order to permit the direction of motion of the watercraft 11 to be controlled, there is provided a reverse thrust bucket assembly, indicated generally by the reference numeral 49.

Conventionally, reverse thrust bucket assemblies are mounted on the steering nozzle. There are some disadvantages to such an arrangement in that it further complicates the mounting and control. In accordance with another important feature of this invention, the reverse thrust bucket 49 is supported by a fixed portion of the watercraft. In this embodiment, the reverse thrust bucket 49 is mounted on the underplate 38.

To accomplish this mounting, the underplate 38 is provided with a pair of mounting brackets 51 which are disposed on opposite sides of the outer housing 26 of the jet propulsion unit 24. The reverse thrust bucket 49 has a pair of side portions 52 that are pivotally connected at their forward ends to the mounting brackets 51 by pivot bolts 53. The rear ends of the arms 52 are connected to a shell-like member 54 of the reverse thrust bucket 49 by means of fasteners such as rivets 55. The shell 54 has a generally curved surface 56 that defines a cavity 57.

One of the arms 52 is provided with a lug 58 to which a wire actuator 59 is connected. The wire actuator 59 extends forwardly to a control lever (not shown) mounted in proximity to the rider 17 so that the reverse thrust bucket may be shifted from a forward drive position, as shown in phantom lines in FIG. 2 wherein the water from the steering nozzle 41 flows unobstructedly in a rearward direction. By pivoting the reverse thrust bucket 49 to the reverse thrust position as shown in solid lines in FIG. 2 and in this condition in the remaining figures, the surface 56 will be in confronting relationship to the steering nozzle 41 regardless of its trim adjusted position. Hence, water that is discharged by the jet propulsion unit 24 will be redirected in a forward direction as shown by the arrows 61 to provide a reverse driving force on the watercraft 41. Even in this reverse mode, trim adjustment of the steering nozzle 41 will effect trim adjustment of the watercraft as shown by the various arrows in FIG. 2.

Figure 4:
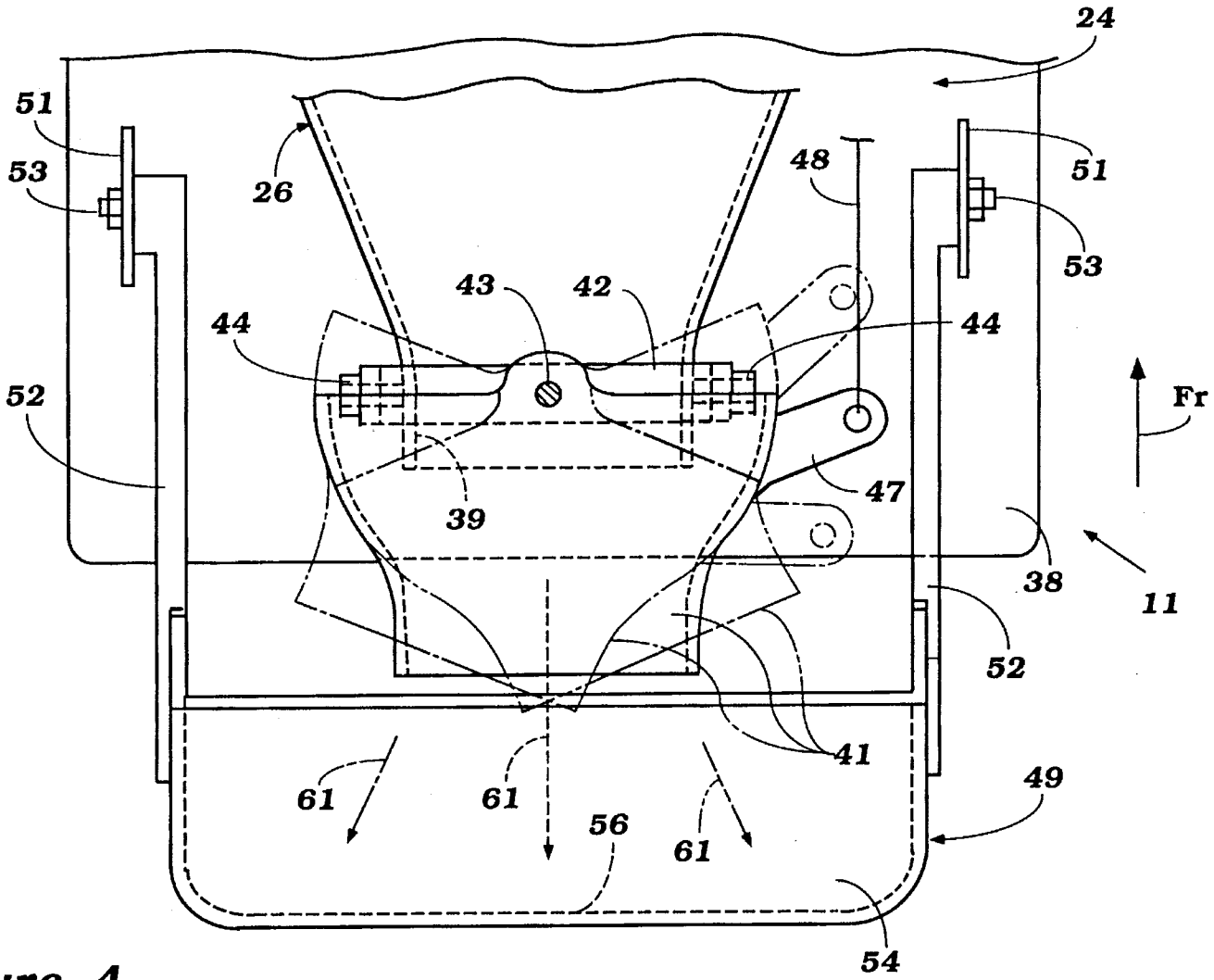
FIG. 4 is an enlarged top plan view of the same area shown in FIGS. 2 and 3 and shows the steering movement of the steering nozzle with the straight-ahead position being shown in solid line views and the extreme right and left-hand turn conditions being shown in phantom.

Furthermore, the reverse thrust bucket 49 and specifically its curved wall 56 is disposed so it will intercept the flow from the steering nozzle 41 regardless of the steered position as clearly shown in FIG. 4. Thus, the structure provides not only trim control in a forward direction, but also in a reverse direction. Furthermore, because the reverse thrust bucket 49 is mounted separately from the steering nozzle 41, its position does not interfere in any way with the steering operation nor is a complicated supporting arrangement required.

Figure 5:
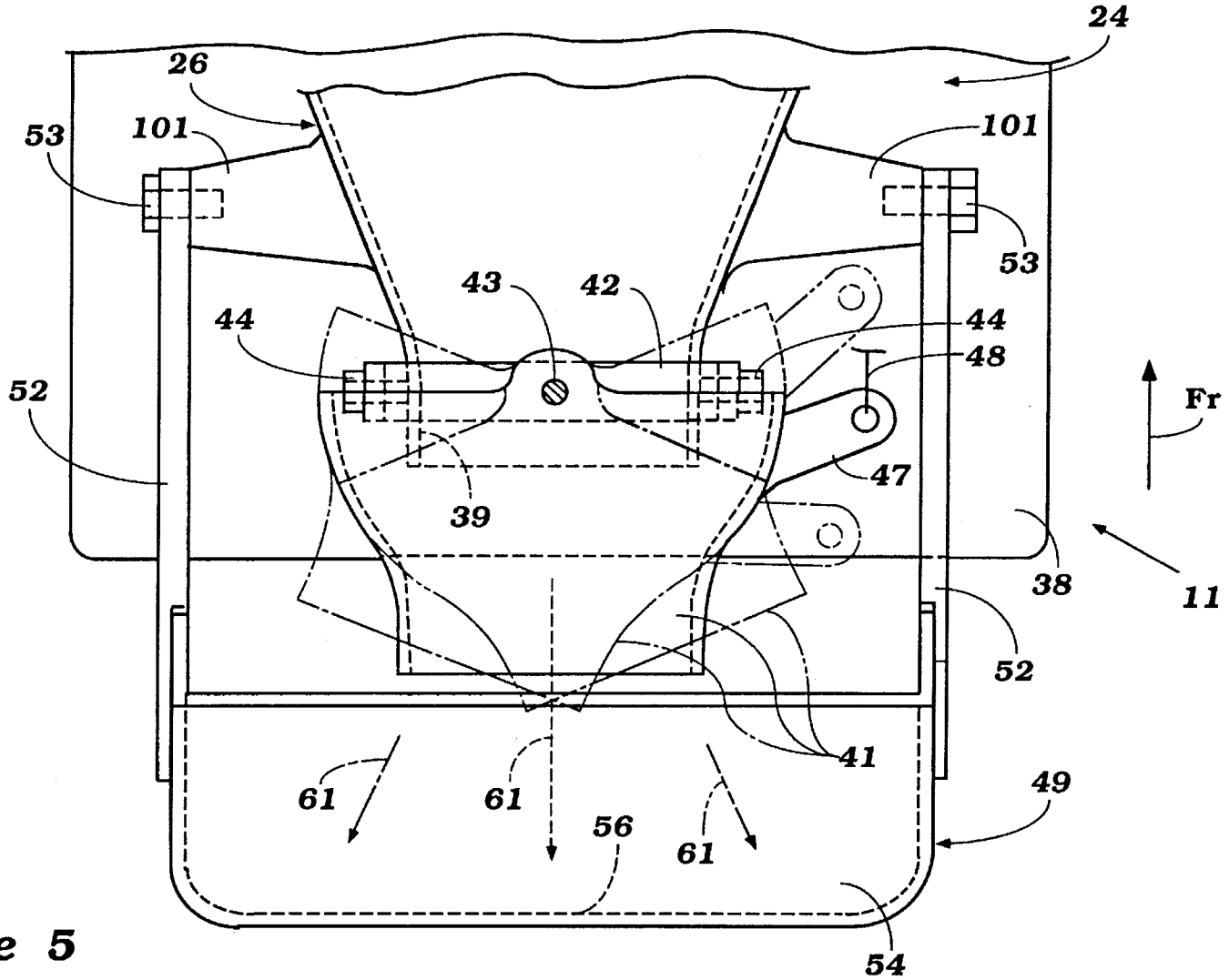
FIG. 5 is a top plan view, in part similar to FIG. 4, and shows another embodiment of the invention.

FIG. 5 shows another embodiment which differs from the embodiment of FIGS. 1–4 only in the manner of mounting of the reverse thrust bucket 49. For this reason, only the mounting arrangement is illustrated and a single view is all that is required to illustrate this construction.

In this embodiment, rather than mounting the reverse thrust bucket 49 on the underplate 38, the reverse thrust bucket 49 is mounted directly on the outer housing 26 of the jet propulsion unit 24. This permits the reverse thrust bucket 49 to form a part of the jet propulsion unit 24 rather than comprising a part of the hull 12. For this purpose, the discharge nozzle portion of the jet propulsion unit outer housing 26 is provided with a pair of outwardly extending support lugs 101. The pivot bolts 53 connect the arms 52 to these lugs 104 rather than the support brackets of the previously described embodiment. In all other regards, this construction operates the same as the previously described embodiment and, for that reason, further description of this embodiment is not believed to be necessary to permit those skilled in the art to practice the invention.

Figure 6:
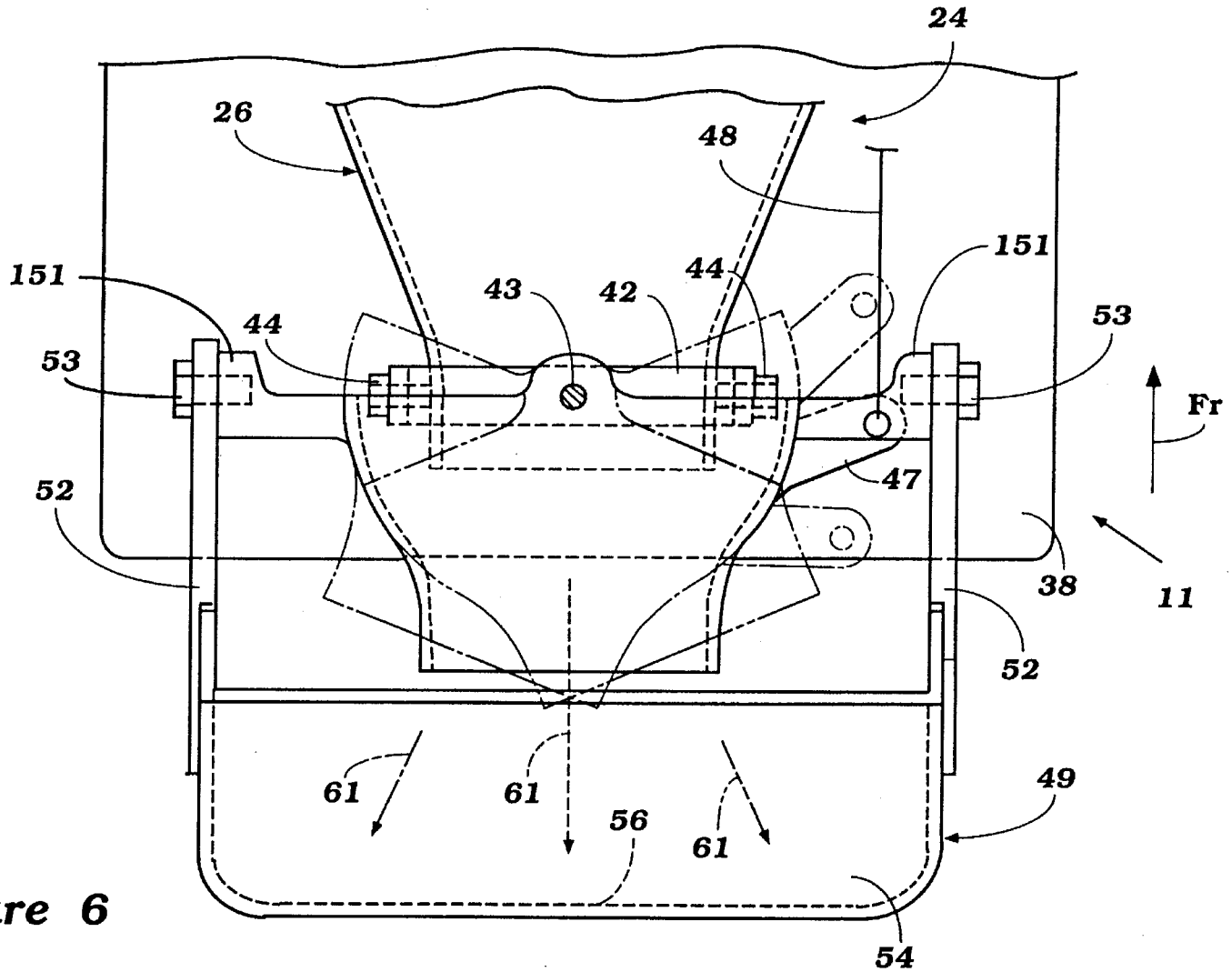
FIG. 6 is a top plan view, in part similar to FIGS. 4 and 5, and shows yet a further embodiment of the invention.

In the embodiments as thus far described, the pivot axis for the reverse thrust bucket 49 has been disposed forwardly of the steering nozzle 41 and has been connected to a fixed element of either the hull 11 or the jet propulsion unit outer housing 26. FIG. 6 shows another embodiment wherein a pair of mounting lugs 151 are formed as part of the steering nozzle 41 and to which the lever arms 52 are connected by means of the pivot bolts 53. Hence, in this embodiment, the reverse thrust bucket 49 will both pivot with the steering nozzle 41 about the steering axis 43, but also will trim about the steering axis defined by the pivot bolts 44.

In all other regards, this embodiment operates the same as those previously described and, for that reason, further description of this embodiment is not believed to be necessary. Where components are the same or substantially the same to those previously described, they have been identified by the same reference numerals and further description of them is not believed to be necessary to permit those skilled in the art to practice the invention.

From the foregoing description it is believed readily apparent that the jet propulsion unit discharge system described is effective not only in permitting steering movement and reverse thrust operation, but also accommodates trim adjustment. Of course, the foregoing description is that of preferred embodiments of the invention, and various changes and modifications may be made without departing from the spirit and scope of the invention, as defined by the appended claims.

I claim:

1. A jet propulsion unit for a watercraft, said jet propulsion unit being comprised of an outer housing defining a water inlet portion adapted to receive water from a body of water in which the watercraft is operating, an impeller portion containing an impeller for drawing water through said water inlet portion and a discharge nozzle portion through which the water pumped by the impeller is discharged for providing a propulsion force to the watercraft, a steering nozzle pivotally supported on said discharge nozzle for pivotal movement about a vertically extending steering axis, and a reverse thrust bucket supported for movement relative to the steering nozzle and independently of said steering nozzle between a forward drive position wherein the water from sad steering nozzle is discharged rearwardly providing a forward driving thrust to the associated watercraft and a reverse position in confronting relationship to said steering nozzle for redirecting the water flow in a forward direction for generating a reverse thrust on the associated watercraft, the path of movement of said reverse thrust bucket being fixed relative to the associated watercraft.

2. A jet propulsion unit for propelling a watercraft as set forth in claim 1, wherein the steering nozzle also is supported on the discharge nozzle for pivotal movement about a horizontally disposed trim axis for effecting trim control of the watercraft.

3. A jet propulsion unit for propelling a watercraft as set forth in claim 2, wherein the steering nozzle is pivotally connected to a gimble ring for movement about one of the axes and wherein the gimble ring is pivotally connected to the outer housing for pivotal movement about the other axis.

4. A jet propulsion unit for propelling a watercraft as set forth in claim 3, wherein the steering nozzle is pivotally connected to the gimble ring about the steering axis and the gimble ring is pivotally connected to the outer housing about the trim axis.

5. A jet propulsion unit for propelling a watercraft as set forth in claim 4, wherein the reverse thrust bucket is supported for pivotal movement about an axis that is disposed parallel to the trim axis.

6. A jet propulsion unit for propelling a watercraft as set forth in claim 5, wherein the reverse thrust bucket axis is offset from the trim axis.

7. A jet propulsion unit for propelling a watercraft as set forth in claim 5, wherein the reverse thrust bucket is pivotally supported independently of the steering nozzle.

8. A jet propulsion unit for propelling a watercraft as set forth in claim 7, wherein the reverse thrust bucket is supported directly by an underplate fixed relative to the jet propulsion unit outer housing.

9. A jet propulsion unit for propelling a watercraft as set forth in claim 7, wherein the reverse thrust bucket is pivotally supported by the outer housing of the jet propulsion unit.

10. A jet propulsion unit for propelling a watercraft as set forth in claim 1, wherein the reverse thrust bucket has a portion defining the curved cavity positioned in confronting relationship with the steering nozzle when the reverse thrust bucket is in its reverse thrust position.

11. A jet propulsion unit for propelling a watercraft as set forth in claim 10, wherein the reverse thrust bucket is supported for pivotal movement about an axis that is disposed parallel to the trim axis.

12. A jet propulsion unit for propelling a watercraft as set forth in claim 11, wherein the reverse thrust bucket axis is offset from the trim axis.

13. A jet propulsion unit for propelling a watercraft as set forth in claim 12, wherein the reverse thrust bucket is supported directly by an underplate fixed relative to the jet propulsion unit outer housing.

14. A jet propulsion unit for propelling a watercraft as set forth in claim 12, wherein the reverse thrust bucket is pivotally supported by the outer housing of the jet propulsion unit.

* * * * *